US009847065B2

(12) United States Patent
Jeong et al.

(10) Patent No.: US 9,847,065 B2
(45) Date of Patent: Dec. 19, 2017

(54) LIQUID CRYSTAL DISPLAY APPARATUS

(71) Applicant: SAMSUNG DISPLAY CO., LTD., Yongin-si, Gyeonggi-Do (KR)

(72) Inventors: Heesoon Jeong, Hwaseong-si (KR); Suhyeong Park, Gyeongju-si (KR); Jimyoung Seo, Hwaseong-si (KR); Soo-Wan Yoon, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 76 days.

(21) Appl. No.: 14/971,476

(22) Filed: Dec. 16, 2015

(65) Prior Publication Data

US 2016/0210916 A1 Jul. 21, 2016

(30) Foreign Application Priority Data

Jan. 16, 2015 (KR) ..... 10-2015-0008243

(51) Int. Cl.
*G09G 3/36* (2006.01)

(52) U.S. Cl.
CPC ..... *G09G 3/3614* (2013.01); *G09G 3/3648* (2013.01); *G09G 2300/0434* (2013.01); *G09G 2310/063* (2013.01)

(58) Field of Classification Search
CPC ... G09G 3/36; G09G 5/00; G09G 5/10; G11C 19/00; G06F 3/038; G06K 9/00
See application file for complete search history.

(56) References Cited

U.S. PATENT DOCUMENTS

2003/0151584 A1* 8/2003 Song ..... G09G 3/3607 345/100
2008/0100600 A1* 5/2008 Hsueh ..... G09G 3/3696 345/204
2008/0143659 A1* 6/2008 Ma ..... G09G 3/3677 345/87
2008/0170017 A1* 7/2008 Jeoung ..... G09G 3/3648 345/87
2008/0224980 A1* 9/2008 Senda ..... G09G 3/3648 345/96
2011/0006974 A1 1/2011 Kim
(Continued)

FOREIGN PATENT DOCUMENTS

KR 1020120045103 5/2012
KR 1020120126643 11/2012

*Primary Examiner* — Pegeman Karimi
(74) *Attorney, Agent, or Firm* — F. Chau & Associates, LLC

(57) ABSTRACT

A display apparatus includes a display panel and a driving circuit. The display panel includes pixels. Each of the pixels is connected to one of gate lines and one of data lines. The driving circuit drives the gate lines and the data lines to display an image on the display panel. The driving circuit alternately provides a first polarity data driving signal and a second polarity data driving signal to each of the plurality of data lines. During an asymmetrical mode, the first polarity data driving signal is provided to first data lines of the data lines during a first frame period before a blank period begins, and the second polarity data driving signal is provided to the first data lines during a second frame period after the blank period ends. The second frame period excludes the blank period.

19 Claims, 8 Drawing Sheets

(56) References Cited

U.S. PATENT DOCUMENTS

| | | | | |
|---|---|---|---|---|
| 2012/0105494 | A1* | 5/2012 | Lee | G09G 3/3614 345/690 |
| 2013/0265347 | A1* | 10/2013 | Bae | G09G 5/10 345/691 |
| 2014/0015819 | A1* | 1/2014 | Yamazaki | G09G 3/3614 345/209 |
| 2014/0055503 | A1* | 2/2014 | Jung | G09G 5/10 345/690 |
| 2014/0160186 | A1 | 6/2014 | Oh et al. | |

* cited by examiner

LIQUID CRYSTAL DISPLAY APPARATUS

CROSS-REFERENCE TO RELATED APPLICATIONS

This U.S. non-provisional patent application claims priority under 35 U.S.C. §119 to Korean Patent Application No. 10-2015-0008243, filed on Jan. 16, 2015, in the Korean intellectual Property Office, the disclosure of which is incorporated by reference herein in its entirety.

TECHNICAL FIELD

The present inventive concept relates to a liquid crystal display apparatus.

DISCUSSION OF THE RELATED ART

A liquid crystal display apparatus such as a flat panel display apparatus includes two sheets of display plates on which electric field generation electrodes such as a pixel electrode and a common electrode are formed and a liquid crystal layer disposed between the two sheets of display plates. The liquid crystal display apparatus applies a voltage to the electric field generation electrodes to generate electric fields in the liquid crystal layer. Thus, alignment of liquid crystal molecules of the liquid crystal layer is determined by the electric fields to control a polarization of incident light, and thus, an image is displayed.

The liquid crystal display apparatus may be driven in various modes. For example, the liquid crystal display apparatus may be driven in a horizontal electric mode, such as an in-plane switching (IPS) mode, a plane line switching (PLS) mode, or the like, in which liquid crystals are driven by horizontal electric fields.

When the liquid crystal display apparatus is driven in the PLS mode, variation of a gray scale may be realized by rotating horizontally aligned liquid crystal molecules by electric fields applied between the pixel electrode and the common electrode.

A flexoelectric effect may occur when a liquid crystal injected into a wedge type cell or the wedge type cell is deformed. The liquid crystal may be polarized due to a flexoelectric effect generated when alignment of the liquid crystal is deformed in a liquid crystal display apparatus driven in the PLS mode, in which electric fields are applied to liquid crystal molecules and the liquid crystal molecules are aligned in an electric field direction.

When the liquid crystal in the liquid crystal display apparatus has the flexoelectric effect, even though a polarity of a voltage of the pixel electrode with respect to a voltage of the common electrode voltage is periodically inverted, the polarization of the liquid crystal due to the flexoelectric effect might not be inverted in polarity. Thus, optical transmittance may be different for each pixel according to the polarity of the voltage of the pixel electrode with respect to the voltage of the common electrode. Thus, the liquid crystal display apparatus may have different brightness in each frame to cause flicker and afterimage phenomena on a screen, and thus, image quality of the liquid crystal display apparatus may deteriorate.

SUMMARY

According to an exemplary embodiment of the present inventive concept, a display apparatus is provided. The display apparatus includes a display panel and a driving circuit. The display panel includes a plurality of pixels. Each of the plurality of pixels is connected to one of a plurality of gate lines and one of a plurality of data lines. The driving circuit is configured to drive the plurality of gate lines and the plurality of data lines to display an image on the display panel. The driving circuit is configured to alternately provide a first polarity data driving signal and a second polarity data driving signal to each of the plurality of data lines. During an asymmetrical mode, the first polarity data driving signal is provided to first data lines of the plurality of data lines during a first frame period before a blank period begins, and the second polarity data driving signal is provided to the first data lines during a second frame period after the blank period ends. The second frame period during which the second polarity data driving signal is provided to the first data lines excludes the blank period.

The plurality of data lines may include the first data lines and second data lines. The driving circuit may include a first gate driver and a second gate driver. The first gate driver may be configured to drive first gate lines of the gate lines. The first gate lines and the first data lines may be connected to first pixels of the pixels. The second gate driver may be configured to drive second gate lines of the gate lines. The second gate lines and the second data lines may be connected to second pixels of the pixels.

When the first polarity data driving signal is provided to each of the first data lines, the second polarity data driving signal may be provided to each of the second data lines.

The first frame period in which the first polarity data driving signal is provided to the first data lines during the asymmetrical mode may be longer than a first frame period in which the first polarity data driving signal is provided to the first data lines during a normal mode.

The second frame period in which the second polarity data driving signal is provided to the first data lines during the asymmetrical mode may be shorter than a second frame period in which the second polarity data driving signal is provided to the first data lines during the normal mode.

The first frame period in which the first polarity data driving signal is provided to the first data lines during the asymmetrical mode may include the blank period.

The first and second polarity driving signals may have opposite polarities to each other with respect to a common voltage.

The driving circuit may further include a voltage generator generating the common voltage.

The driving circuit may further include a timing controller and a source driver. The timing controller may be configured to output a first control signal including a data signal. The first control may be output in response to an image signal and a control signal. The source driver may be configured to output the first polarity data driving signal and the second polarity data driving signal in response to the data signal and the first control signal.

The timing controller may output a second control signal for controlling the first gate driver in response to the control signal, and a third control signal for controlling the second gate driver in response to the control signal.

The timing controller may further output a fourth control signal. The voltage generator may adjust a voltage level of the common voltage in response to the fourth control signal.

According to an exemplary embodiment of the present inventive concept, a display apparatus is provided. The display apparatus includes a display panel and a driving circuit. The display panel includes first pixels and second pixels. Each of the first pixels is connected to one of first gate lines and one of first data lines. Each of the second pixels is connected to one of second gate lines and one of second data lines. The driving circuit is configured to drive the first and second gate lines and the first and second data lines. The driving circuit is configured to provide a first polarity data driving signal to each of the first pixels, and to provide a second polarity data driving signal to each of the second pixels in a first period. The driving circuit is configured to provide the second polarity data driving signal to each of the first pixels, and to provide the first polarity data driving signal to each of the second pixels in a second period. During an asymmetrical mode, a first frame in which the first polarity data driving signal is provided to each of the first pixels has a different period from that of a second frame in which the second polarity data driving signal is provided to each of the first pixels.

The first frame may include a blank period. The first polarity data driving signal may be provided to each of the first pixels before the blank period begins, and the second polarity data driving signal may be provided to each of the first pixels after the blank period ends.

The first and second polarity driving signals may have opposite polarities to each other with respect to a common voltage. The driving circuit may include a voltage generator adjusting a voltage level of the common voltage.

During an asymmetrical mode, an amount of difference in period between the first frame and the second frame may be changed according to the adjusted voltage level of the common voltage.

The first frame in which the first polarity data driving signal is provided to each of the first pixels during the asymmetrical mode may have a longer period than that of a third frame in which the first polarity data driving signal is provided to each of the first pixels during a normal mode.

A fourth frame in which the second polarity data driving signal is provided to each of the first pixels during the asymmetrical mode may have a shorter period than a fifth frame in which the second polarity data driving signal is provided to each of the second pixels during the normal mode.

BRIEF DESCRIPTION OF THE DRAWINGS

The above and other features of the present inventive concept will become more apparent with reference to the following figures, in which.

DETAILED DESCRIPTION OF THE EMBODIMENTS

Hereinafter, exemplary embodiments of the present inventive concept will be described in detail with reference to the accompanying drawings.

Figure 1:
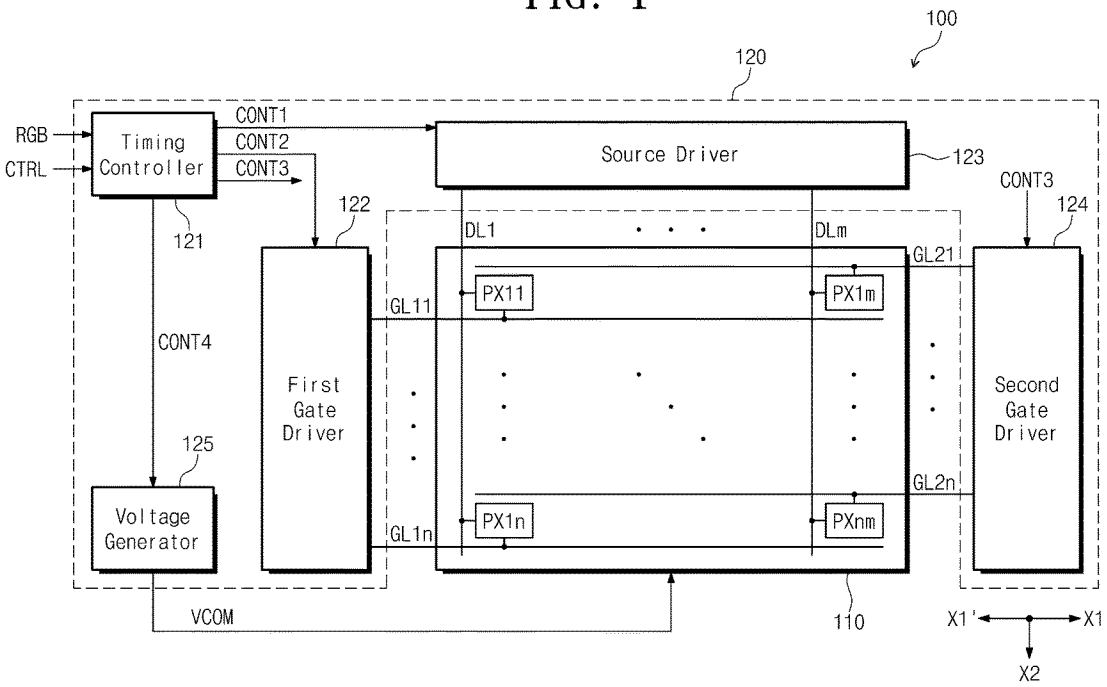
FIG. 1 is a block diagram of a liquid crystal display apparatus according to an exemplary embodiment of the present inventive concept.
Figure 2:
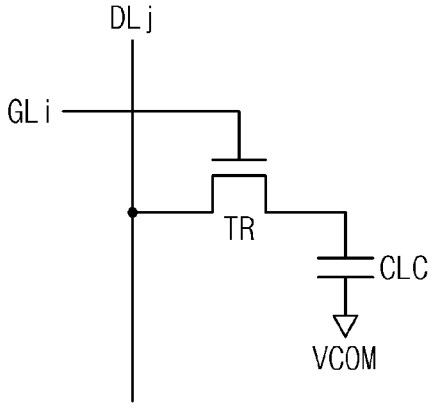
FIG. 2 is a circuit diagram of a pixel of FIG. 1 according to an exemplary embodiment of the present inventive concept.

FIG. 1 is a block diagram of a liquid crystal display apparatus 100 according to an exemplary embodiment of the present inventive concept. FIG. 2 is a circuit diagram of a pixel of FIG. 1 according to an exemplary embodiment of the present inventive concept.

Referring to FIGS. 1 and 2, the liquid crystal display apparatus 100 includes a display panel 110 and a driving circuit 120. The driving circuit 120 includes a timing controller 121, a first gate driver 122, a source driver 123, a second gate driver 124, and a voltage generator 125.

The display panel 110 includes a plurality of data lines DL1 to DLm, a plurality of first gate lines GL11 to GL1n, and a plurality of second gate lines GL21 to GL2n. The first and second gate lines GL11 to GL1n and GL21 to GL2n are arranged to cross the data lines DL1 to DLm. The display panel 110 further includes a plurality of pixels PX11 to PXnm, each of which is arranged on an area on which each of the data lines DL1 to DLm and each of the gate lines GL11 to GL1n and GL21 to GL2n cross each other. Here, n and m are positive integers. The plurality of first gate lines GL1 to GLn extend from the first gate driver 122 in a first direction X1 and are spaced apart from each other in a second direction X2. The plurality of second gate lines GL21 to GL2n extend from the second gate driver 124 in a third direction X1 and are spaced apart from each other in the second direction X2. The third direction X1' is substantially opposite to the first direction X1. The plurality of data lines DL1 to DLm extend from the source driver 123 in the second direction X2 and are spaced apart from each other in the first direction X1. The data lines DL1 to DLm and the first and second gate lines GL11 to GL and GL2 to GL2n are electrically insulated from each other.

As illustrated in FIG. 2, each of pixels PXij (here, i and j are positive integers ($1 \le i \le n$, $1 \le j \le m$)) may include a switching transistor TR connected to a corresponding data line DLj and a corresponding first gate line GL1i (or a second gate line GL2i), and a liquid crystal capacitor CLC connected to the switching transistor TR.

The timing controller 121 receives an image signal RGB and a control signal CTRL, which are provided from the outside. The timing controller 121 provides a first control signal CONT1 to the source driver 123, a second control signal CONT2 to the first gate driver 122, a third control signal CONT3 to the second gate driver 124, and a fourth control signal CONT4 to the voltage generator 125. The first control signal CONT1 may include a data signal and a clock signal. The first control signal CONT 1 may further include a polarity control signal and a load signal.

The source driver 123 drives the plurality of data lines DL1 to DLm in response to the first control signal CONT1 outputted from the timing controller 121. The source driver 123 may be realized as an independent integrated circuit. Thus, the source driver 123 may be electrically connected to a side of the display panel 110, or directly mounted on the display panel 110. In addition, the source driver 123 may be realized as a single chip or may include a plurality of chips. In an exemplary embodiment, the source driver 123 may change output timing of a data driving signal provided to the data lines DL1 to DLm.

The first gate driver 122 drives the first gate lines GL11 to GL1n in response to the second control signal CONT2 outputted from the timing controller 121. The second gate driver 124 drives the second gate lines GL21 to GL2n in response to the third control signal CONT3 outputted from the timing controller 121.

The first gate driver 122 may be realized as an independent integrated circuit chip. Thus, the first gate driver 122 may be electrically connected to one side (e.g., a left side of the display panel 110 of FIG. 1) of the display panel 110. The second gate driver 124 may be realized as an independent integrated circuit chip. Thus, the second gate driver 124 may be electrically connected to another side (e.g., a right side of the display panel 110 of FIG. 1) of the display panel 110. Each of the first gate driver 122 and the second gate driver 124 may be realized as a circuit using an oxide semiconductor, a crystalline semiconductor, a polycrystalline semiconductor, an amorphous silicon gate using an amorphous silicon thin film transistor (a-Si TFT), and thus may be integrated within a predetermined area of the display panel 110. In an exemplary embodiment, each of the first gate driver 122 and the second gate driver 124 may be realized as a tape carrier package (TCP), a chip on film (COF), or the like.

The voltage generator 150 generates a common voltage VCOM in response to the fourth control signal CONT4 outputted from the timing controller 121. The voltage generator 150 may change a voltage level of the common voltage VCOM according to the fourth control signal CONT4. The voltage generator 150 may further generate various voltages that are required for operating the liquid crystal display apparatus 100 in addition to the common voltage VCOM.

When a gate-on voltage is applied to a certain gate line GLi, a switching transistor TR of each of the one row pixels PXi1 to PXim that are connected to the gate line GLi is turned on. Here, the source driver 123 provides data driving signals corresponding to data signals included in the first control signal CONT1 to the data lines DL1 to DLm. The data driving signals provided to the data lines DL1 to DLm may be respectively applied to corresponding pixels (e.g., PXi1 to PXim) through the switching transistor TR that is turned on. Here, a time that is taken to turn on one of row switching transistors TRs, which correspond to, e.g., the pixels PXi1 to PXim, respectively, is referred to as '1 horizontal period 1H'.

The source driver 123 of the liquid crystal display apparatus 100 inversely drives the data driving signals provided to the data lines DL1 to DLm to prevent the liquid crystal capacitor CLC from being degraded. For example, a polarity of a voltage of the pixel electrode with respect to the common voltage VCOM of the liquid crystal capacitor CLC is periodically inverted. When the liquid crystal capacitor CLC has a flexoelectric effect, polarization of the liquid crystal due to the flexoelectric effect might not be inverted according to the inverted voltage polarity of the pixel electrode with respect to the common voltage VCOM. Thus, optical transmittance in each pixel may be different according to the polarity of the voltage of the pixel electrode with respect to the common voltage VCOM.

Figure 3:
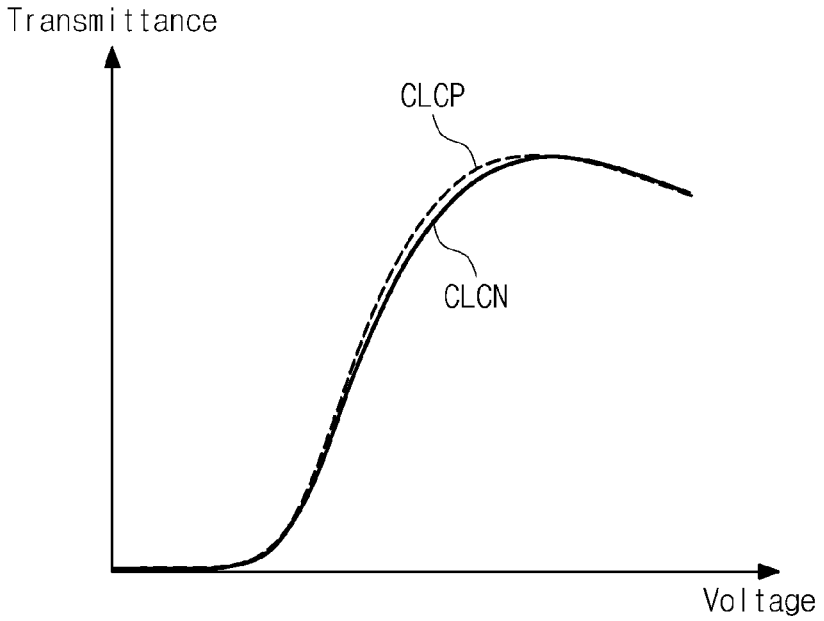
FIG. 3 is a view illustrating a voltage-transmittance relationship of a liquid crystal capacitor in a positive frame and a negative frame according to an exemplary embodiment of the present inventive concept.

FIG. 3 is a view illustrating a voltage-transmittance relationship of a liquid crystal capacitor in a positive frame and a negative frame according to an exemplary embodiment of the present inventive concept.

Referring to FIG. 3, light transmittance CLCP in a positive frame may be different from light transmittance CLCN in a negative frame. Here, the positive frame corresponds to a frame in which a voltage of a pixel electrode of the liquid crystal capacitor CLC is greater than the common voltage VCOM, and the negative frame corresponds to a frame in which the voltage of the pixel electrode of the liquid crystal capacitor CLC is lower than the common voltage VCOM. In this case, since the liquid crystal display apparatus 100 has different brightness in each frame, flicker and afterimage phenomena on a screen may be recognized by the user.

Figure 4:
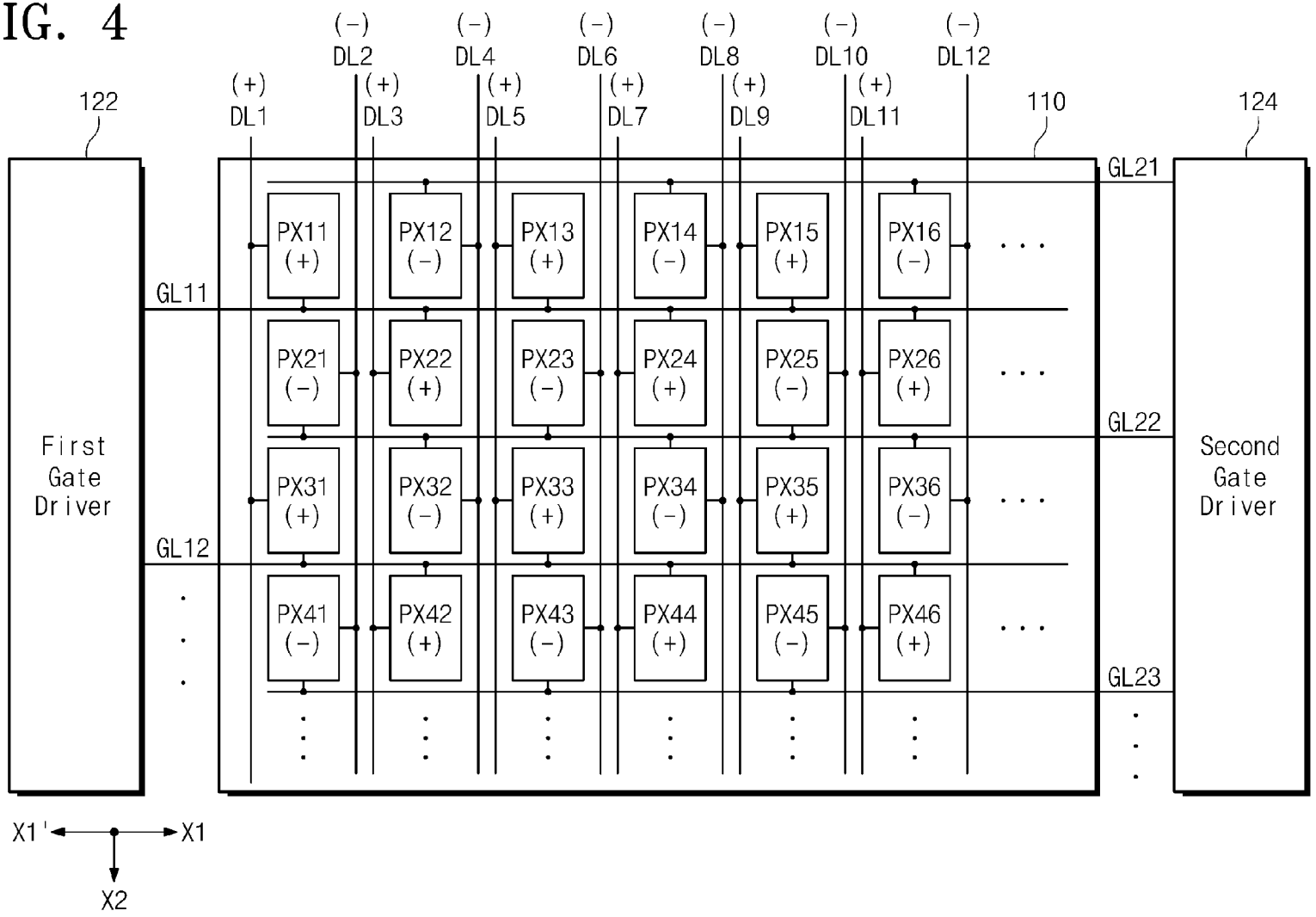
FIG. 4 is a view illustrating a portion of a display panel of FIG. 1 according to an exemplary embodiment of the present inventive concept.

FIG. 4 is a view illustrating a portion of a display panel 110 of FIG. 1 according to an exemplary embodiment of the present inventive concept.

Referring to FIG. 4, the display panel 110 includes a plurality of pixels PX11 to PX46. The pixels PX11, PX13, PX15, PX22, PX24, and PX26 are connected to a first gate line GL11. The pixels PX12, PX14, and PX16 are connected to a second gate line GL21. The pixels PX21, PX23, PX25, PX32, PX34, and PX36 may be connected to a second gate line GL22. The pixels PX31, PX33, PX35, PX42, PX44, and PX46 are connected to a first gate line GL12. The pixels PX41, PX43, and PX45 are connected to a second gate line GL23. The first gate lines GL11 and GL12 and the second gate lines GL21, GL22, and GL23 may be alternately arranged between the pixels in the second direction X2.

Two data lines of the data lines DL1 to DL12 are arranged between two adjacent pixels in the first direction X1. For example, the data lines DL2 and DL3 are arranged between the pixels PX11 and PX12, and the data lines DL4 and DL5 are arranged between the pixels PX12 and PX13. The pixels PX11 and PX31 are connected to the data line DL1. The pixels PX21 and PX41 are connected to the data line DL2. The pixels PX22 and PX42 are connected to the data line DL3. The pixels PX 12 and PX32 are connected to the data line DL4.

When a positive data driving signal (+) is provided to the odd-order data lines DL1, DL3, DL5, and DL7 of the data lines DL1 to DL12 and a negative data driving signal (−) is provided to the even-order data lines DL2, DL4, DL6, and DL8 of the data lines DL1 to DL12, the pixels PX11 to PX46 of the display panel 110 may be driven in a dot inversion method.

When the pixels (e.g., PX11, PX13, PX15, PX22, PX24, PX26, PX31, PX33, PX35, PX42, PX44, and PX46), each of which is connected to one of the first gate lines (e.g., GL11 and GL12) driven by the first gate driver 122, is driven by the positive data driving signal (+), the pixels (e.g., PX12, PX14, PX16, PX21, PX23, PX25, PX32, PX34, and PX36), each which is connected to one of the second gate lines (e.g., GL21 and GL22) driven by the second gate driver 124, may be driven by the negative data driving signal (−). In addition, when the pixels (e.g., PX11, PX13, PX15, PX22, PX24, PX26, PX31, PX33, PX35, PX42, PX44, and PX46) is driven by the negative data driving signal (−), the pixels (e.g., PX12, PX14, PX16, PX21, PX23, PX25, PX32, PX34, and PX36) may be driven by the positive data driving signal (+).

For example, in a first frame, the pixels each connected to one of the first gate lines driven by the first gate driver 122 may be driven by the positive data driving signal (+) and the pixels each connected to one of the second gate lines driven by the second gate driver 124 may be driven by the negative data driving signal (−), and in a second frame subsequent to the first frame, the pixels each connected to one of the first gate lines driven by the first gate driver 122 may be driven by the negative data driving signal (−) and the pixels each connected to one of the second gate lines driven by the second gate driver 124 may be driven by the positive data driving signal (+).

Figure 5:
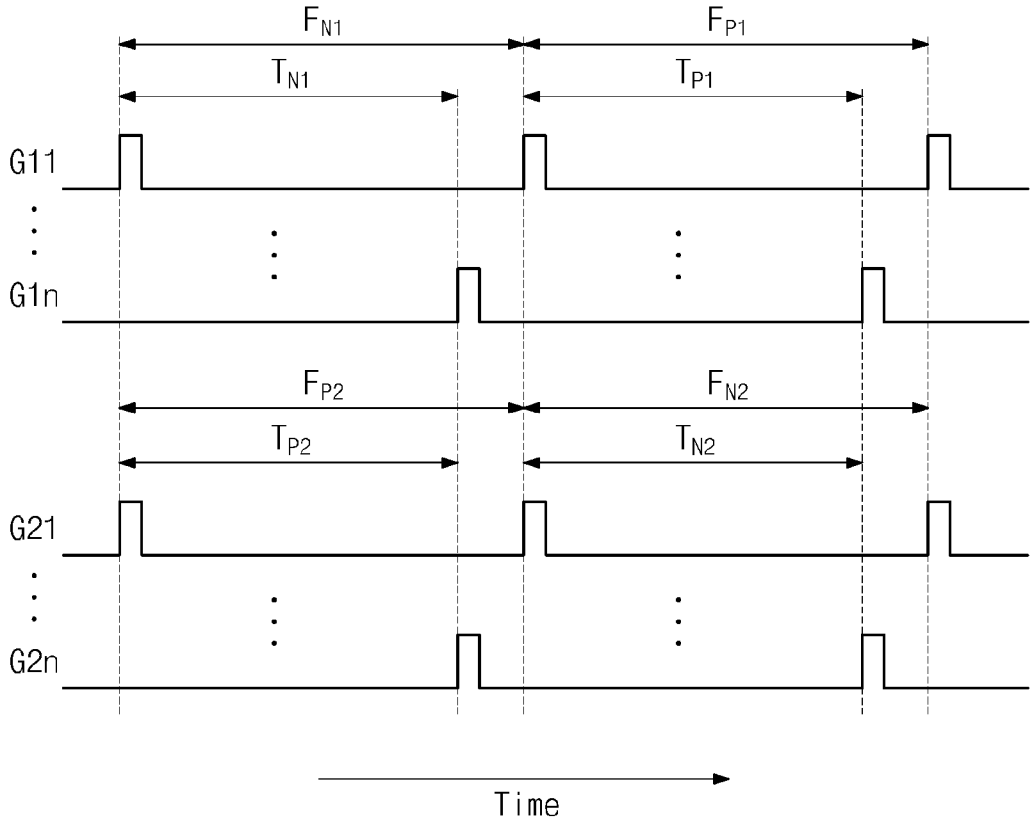
FIG. 5 is a timing view illustrating a first gate signal outputted from a first gate driver and a second gate signal outputted from a second gate driver of FIG. 4 during a normal mode according to an exemplary embodiment of the present inventive concept.

FIG. 5 is a timing view illustrating a first gate signal outputted from a first gate driver and a second gate signal outputted from a second gate driver of FIG. 4 during a normal mode according to an exemplary embodiment of the present inventive concept.

Referring to FIGS. 4 and 5, the first gate driver 122 outputs first gate signals G11 to G1n, each of which is provided to a corresponding one of the gate lines GL11 to GL1n. The second gate driver 124 outputs second gate signals G21 to G2n, each of which is provided to a corresponding one of the second gate lines GL21 to GL2n.

A negative frame period $F_{N1}$ and a positive frame period $F_{P1}$ of the first gate signals G11 to G1n have the same length as each other during a normal mode. In addition, a time duration $T_{N1}$, in the negative frame period $F_{N1}$, between an activation time (e.g., a rising time) of a first one G11 of the first gate signals G11 to G1n and an activation time (e.g., a rising time) of the last one G1n of the first gate signals G11 to G1n may be the same as a time duration $T_{P1}$, in the positive frame period $F_{P1}$, between an activation time of the first one G11 of the first gate signals G11 to G1n and the last one G1n of the first gate signals G11 to G1n.

In addition, the negative frame period $F_{N2}$ and the positive frame period $F_{P2}$ of the second gate signals G21 to G2n have the same length as each other during the normal mode. In addition, a time duration $T_{N2}$, in the negative frame period $F_{N2}$, between an activation time (e.g., a rising time) of a first one G21 of the second gate signals G21 to G2n and an activation time (e.g., a rising time) of the last one G2n of the second gate signals G21 to G2n may be the same as a time duration $T_{P2}$, in the positive frame period $F_{P2}$, between an activation time of the first one G21 of the second gate signals G21 to G2n and an activation time of the last one G2n of the second gate signals G21 to G2n.

As illustrated in FIG. 3, when the light transmittance CLCP in the positive frame in which a voltage of the liquid crystal capacitor CLC is greater than the common voltage VCOM is different from the light transmittance CLCN in the negative frame in which a voltage of the liquid crystal capacitor CLC is smaller than the common voltage VCOM, the voltage level of the common voltage VCOM may be adjusted. The adjustment may compensate for the difference in light transmittance between the positive and negative frames.

The timing controller of FIG. 1 outputs second to fourth control signals CONT1 to CONT4 so that each of the source driver 123, the first gate driver 122, the second gate driver 124, and the voltage generator operates in an asymmetric mode. The voltage generator 125 adjusts a level of the common voltage VCOM in response to the fourth control signal CONT4 outputted from the timing controller. The source driver 123, the first gate driver 122, and the second driver 124 may drive the data lines DL1 to DLm, the first gate lines GL11 to GL1n, and the second gate lines GS21 to GL2n, respectively, by changing a duration of a corresponding horizontal period.

Figure 6:
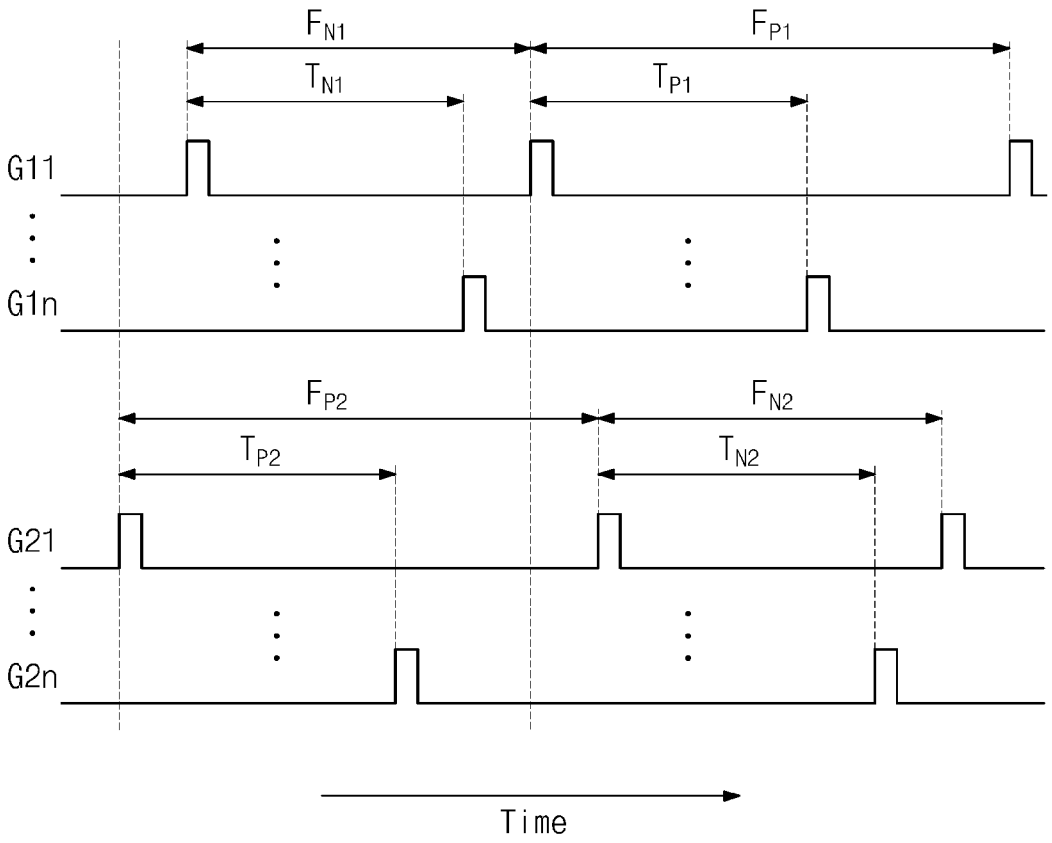
FIG. 6 is a timing view illustrating the first gate signal outputted from the first gate driver and the second gate signal outputted from the second gate driver of FIG. 4 during an asymmetrical mode according to an exemplary embodiment of the present inventive concept.

FIG. 6 is a timing view illustrating the first gate signal outputted from the first gate driver and the second gate signal outputted from the second gate driver of FIG. 4 during an asymmetrical mode according to an exemplary embodiment of the present inventive concept.

Referring to FIGS. 4 and 6, the negative frame period $F_{N1}$ and the positive frame period $F_{P1}$ of the first gate signals G11 to G1n have different lengths from each other during the asymmetrical mode. In addition, the time duration $T_{N1}$, in the negative frame period $F_{N1}$, between an activation time (e.g., a rising time) of the first one G11 of the first gate signals G11 to G1n and an activation time (e.g., a rising time) of the last one G1n of the first gate signals G11 to G1n may be the same as the time duration $T_{P1}$, in the positive frame period $F_{P1}$, between an activation time of the first one G11 of the first gate signals G11 to G1n and an activation time of the last one G1n of the first gate signals G11 to G1n.

The negative frame period $F_{N1}$ of the first gate signals G11 to G1n during the asymmetrical mode is shorter than the negative frame period $F_{N1}$ of the first gate signals G11 to G1n during the normal mode. The positive frame period $F_{P1}$ of the first gate signals G11 to G1n during the asymmetrical mode is longer than the positive frame period $F_{P1}$ of the first gate signals G11 to G1n during the normal mode.

In addition, the negative frame period $F_{N2}$ and the positive frame period $F_{P2}$ of the second gate signals G21 to G2n have different lengths from each other during the asymmetrical mode. In addition, the time duration $T_{N2}$, in the negative frame period $F_{N2}$, between an activation time (e.g., a rising time) of the first one G21 of the second gate signals G21 to G2n and an activation time (e.g., a rising time) of the last one G2n of the second gate signals G21 to G2n may be the same as the time duration $T_{P2}$, in the positive frame period $F_{P2}$, between an activation time of the first one G21 of the second gate signals G21 to G2n and an activation time of the last one G2n of the second gate signals G21 to G2n.

The negative frame period $F_{N2}$ of the second gate signals G21 to G2n during the asymmetrical mode is shorter than the negative frame period $F_{N2}$ of the second gate signals G21 to G2n during the normal mode. The positive frame period $F_{P2}$ of the second gate signals G21 to G2n during the asymmetrical mode is longer than the positive frame period $F_{P2}$ of the second gate signals G21 to G2n during the normal mode.

Referring to FIG. 6, the positive frame period $F_{P1}$ of the first gate signals G11 to G1n is longer than the negative frame period $F_{N1}$ of the first gate signals G11 to G1n during the asymmetrical mode. Thus, in each of the pixels PX11 to PX46, a retention time of each of the positive data driving signals (+) respectively provided to the data lines DL1, DL3, DL5, DL7, DL9, and DL11 is longer than that of each of the negative data driving signals (−) respectively provided to the data lines DL2, DL4, DL6, DL8, DL10, and DL12. When the common voltage VCOM is adjusted toward the positive data driving signal (+) (e.g., a positive voltage direction), the positive frame period $F_{P1}$ has a length longer than that of the negative frame period $F_{N1}$ to compensate the adjusted common voltage VCOM. In an exemplary embodiment, when the common voltage VCOM is adjusted toward the negative data driving signal (−) (e.g., a negative voltage direction), the positive frame period $F_{P1}$ may have a length shorter than that of the negative frame period $F_{N1}$ to compensate the adjusted common voltage VCOM. In addition, as illustrated in FIG. 4, the first gate lines GL11 and GL12 connected to the pixels receiving the positive data driving signals (+) and the second gate lines GL21 and GL22 connected to the pixels receiving the negative data driving signals (−) are separated from each other, and thus, during the asymmetrical mode, the negative and positive frame periods $F_{N1}$ and $F_{P1}$ of the first gate signals GL11 and GL12 are set in a different manner from the negative and positive frame periods $F_{N2}$ and $F_{P2}$ of the second gate signals GL21 and GL22.

Although FIG. 6 illustrates that each of the positive frame periods $F_{P1}$ and $F_{P2}$ of the first and second gate signals G11 to G1n and G21 to G2n is longer than each of the negative frame periods $F_{N1}$ and $F_{N2}$ in FIG. 6, the present inventive concept is not limited thereto. For example, each of the positive frame periods $F_{P1}$ and $F_{P2}$ may be shorter than each of the negative frame periods $F_{N1}$ and $F_{N2}$.

Figure 7:
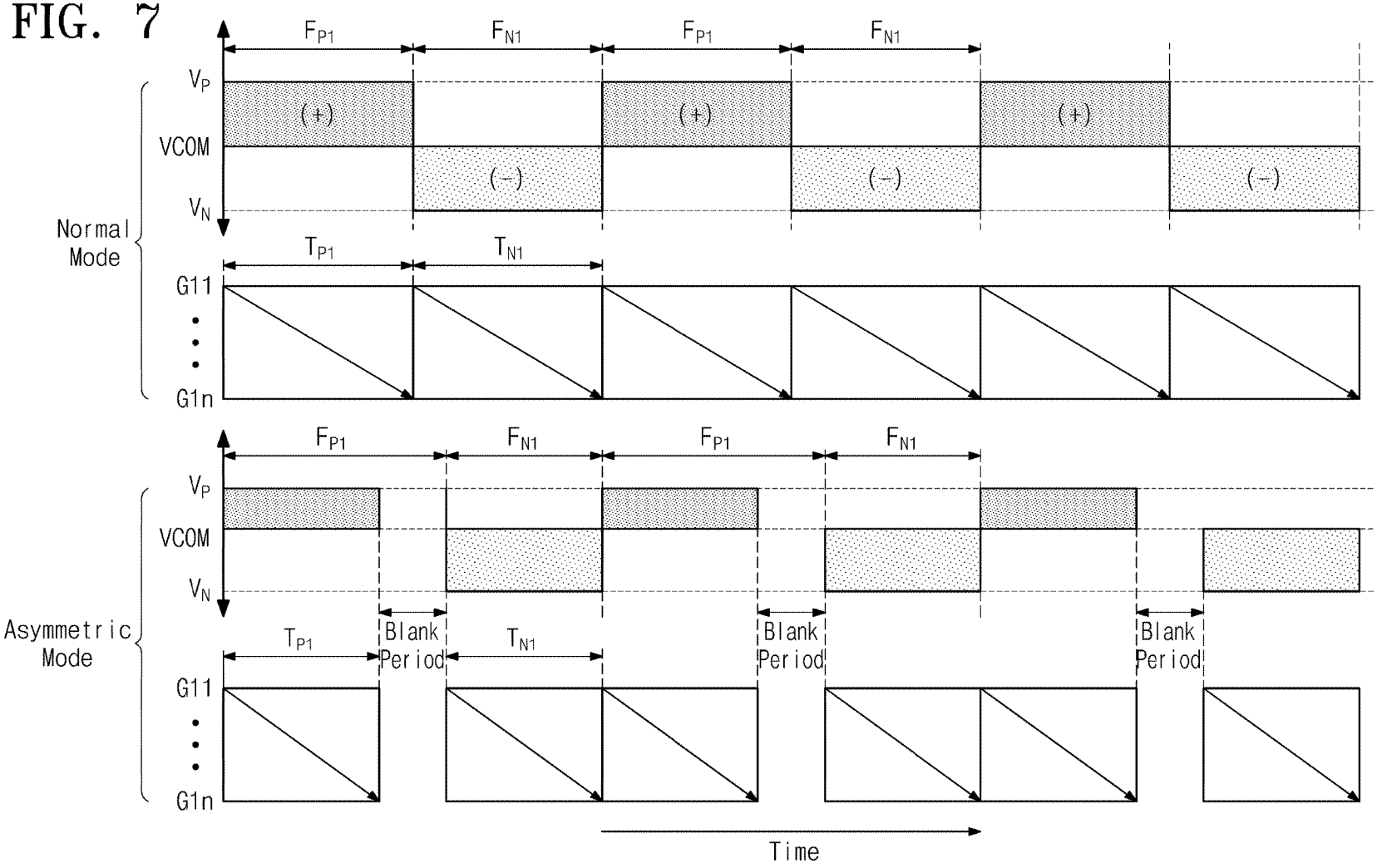
FIG. 7 is a view illustrating a driving manner of first gate lines of FIG. 1 according to an exemplary embodiment of the present inventive concept.

FIG. 7 is a view illustrating a driving manner of first gate lines of FIG. 1 according to an exemplary embodiment of the present inventive concept.

Referring to FIGS. 1 and 7, when the positive data driving signal (+) and the negative data driving signal (−) are provided to the data lines DL1 to DLm during the normal mode, a maximum voltage level VP of the positive data driving signal (+) and a maximum voltage level VN of the negative data driving signal (−) are the same (e.g., VP=VN) as each other with respect to the common voltage VCOM. The negative frame period $F_{N1}$ and the positive frame period $F_{P1}$ of the first gate signals G11 to G1n have the same length as each other. In addition, a time duration $T_{N1}$, in the positive frame period $F_{P1}$ between an activation time (e.g., a rising time) of the first one G11 of the first gate signals G11 to G1n and an activation time (e.g., a rising time) of the last one G1n of the first gate signals G11 to G1n may be the same as a time duration $T_{N1}$, in the negative frame period $F_{N1}$ between an activation time (e.g., a rising time) of the first one G11 of the first gate signals G11 to G1n and an activation time (e.g., a rising time) of the last one Gin of the first gate signals G11 to G1n.

During the asymmetrical mode, a maximum voltage level VP of the positive data driving signal (+) and a maximum voltage level VN of the negative data driving signal (−) are different from each other (e.g., VP*VN) with respect to the common voltage VCOM.

Referring to FIG. 7, in the asymmetrical mode, the positive frame period $F_{P1}$ of the first gate signals G11 to G1n is longer than the negative frame period $F_{N1}$ of the first gate signals G11 to G1n. A time duration $T_{P1}$, in the positive frame period $F_{P1}$ during the asymmetrical mode, between an activation time of the first one G11 of the first gate signals G11 to G1n and an activation time of the last one G1n of the first gate signals G11 to G1n is shorter than the time duration $T_{P1}$ in the positive frame period $F_{P1}$ during the normal mode. In addition, a time duration $T_{N1}$, in the negative frame period $F_{N1}$ during the asymmetrical mode, between an activation time of the first one G11 of the first gate signals G11 to G1n and an activation time of the last one G1n of the first gate signals G11 to G1n is shorter than the time duration $T_{N1}$ in the negative frame period $F_{N1}$ during the normal mode.

The positive frame period $F_{P1}$ during the asymmetrical mode may include a blank period for which the gate lines are not driven. The blank period may correspond to a period until the negative frame period $F_{N1}$ starts after the last one G1n of the first gate signals G11 to G1n is activated. The positive data driving signal (+), which is provided to a corresponding one of the pixels PX11 to PXnm through a corresponding one of the data lines DL1 to DLm, is maintained during the blank period. When the common voltage VCOM is adjusted toward the positive data driving signal (+), the positive frame period $F_{P1}$ has a length longer than that of the negative frame period $F_{N1}$ to compensate the adjusted common voltage VCOM.

Figure 8:
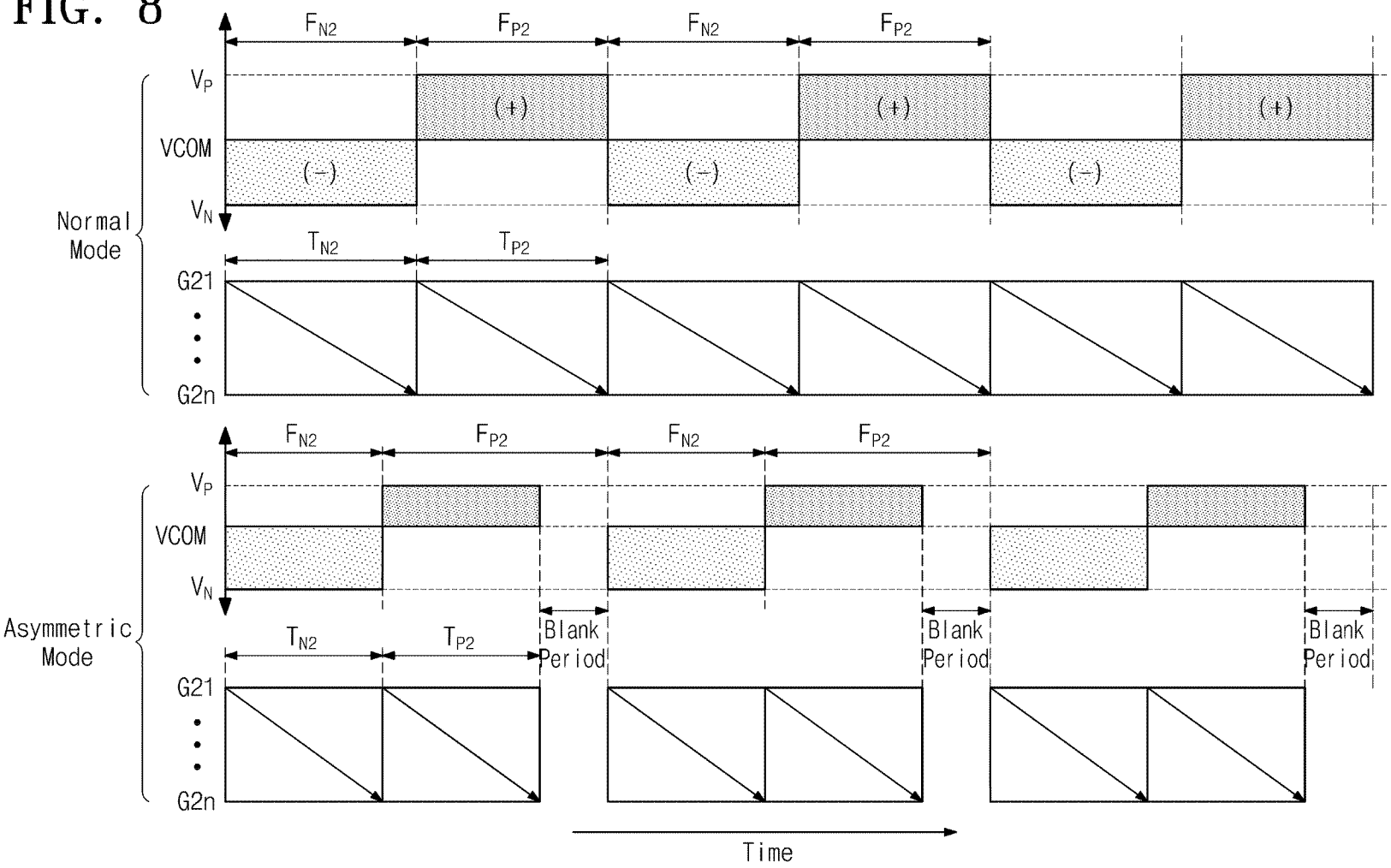
FIG. 8 is a view illustrating a driving manner of second gate lines of FIG. 1 according to an exemplary embodiment of the present inventive concept.

FIG. 8 is a view illustrating a driving manner of second gate lines of FIG. 1 according to an exemplary embodiment of the present inventive concept.

Referring to FIGS. 1 and 8, when the positive data driving signal (+) and the negative data driving signal (−) are provided to the data lines DL1 to DLm during the normal mode, a maximum voltage level VP of the positive data driving signal (+) with respect to the common voltage VCOM and a maximum voltage level VN of the negative data driving signal (−) with respect to the common voltage VCOM are the same (e.g., VP=VN) as each other. The negative frame period $F_{N2}$ and the positive frame period $F_{P2}$ of the second gate signals G21 to G2n have the same length as each other during the normal mode. In addition, a time duration $T_{P2}$, in the positive frame period $FP_2$ between an activation time (e.g., a rising time) of the first one G21 of the second gate signals G21 to G2n and an activation time of the last one G2n of the second gate signals G21 to G2n may be the same as a time duration $T_{N2}$, in the negative frame period $F_{N2}$ between an activation time (e.g., a rising time) of the first one G21 of the second gate signals G21 to G2n and an activation time of the last one G2n of the second gate signals G21 to G2n.

During the asymmetrical mode, a maximum voltage level VP of the positive data driving signal (+) and a maximum voltage level VN of the negative data driving signal (−) are different from each other (e.g., VP*VN) with respect to the common voltage VCOM.

Referring to FIG. 8, in the asymmetrical mode, the positive frame period $F_{P2}$ of the second gate signals G21 to G2n is longer than the negative frame period $F_{N2}$ of the second gate signals G21 to G2n. A time duration $TP_2$, in the positive frame period $FP_2$ during the asymmetrical mode, between an activation time of the first one G21 of the second gate signals G21 to G2n and an activation time of the last one G2n of the second gate signals G21 to G2n is shorter than the time duration $T_{P2}$ in the positive frame period $F_{P2}$ during the normal mode. In addition, a time duration $T_{N2}$, in the negative frame period $F_{N2}$ during the asymmetrical mode, between an activation time of the first one G21 of the second gate signals G21 to G2n and an activation time of the last one G1n of the second gate signals G21 to G2n is shorter than the time duration $T_{N2}$ in the negative frame period $F_{N2}$ during the normal mode.

The positive frame period $F_{P2}$ during the asymmetrical mode may include a blank period for which the gate lines are not driven. The blank period may correspond to a period until the negative frame period $F_{N2}$ starts after the last one G2n of the second gate signals G21 to G2n is activated. The positive data driving signal (+), which is provided to a corresponding one of the pixels PX11 to PXnm through a corresponding one of the data lines DL1 to DLm is maintained during the blank period. When the common voltage VCOM is adjusted toward the positive data driving signal (+), the positive frame period $F_{P2}$ has a length longer than that of the negative frame period $F_{N2}$ to compensate the adjusted common voltage VCOM.

Figure 9:
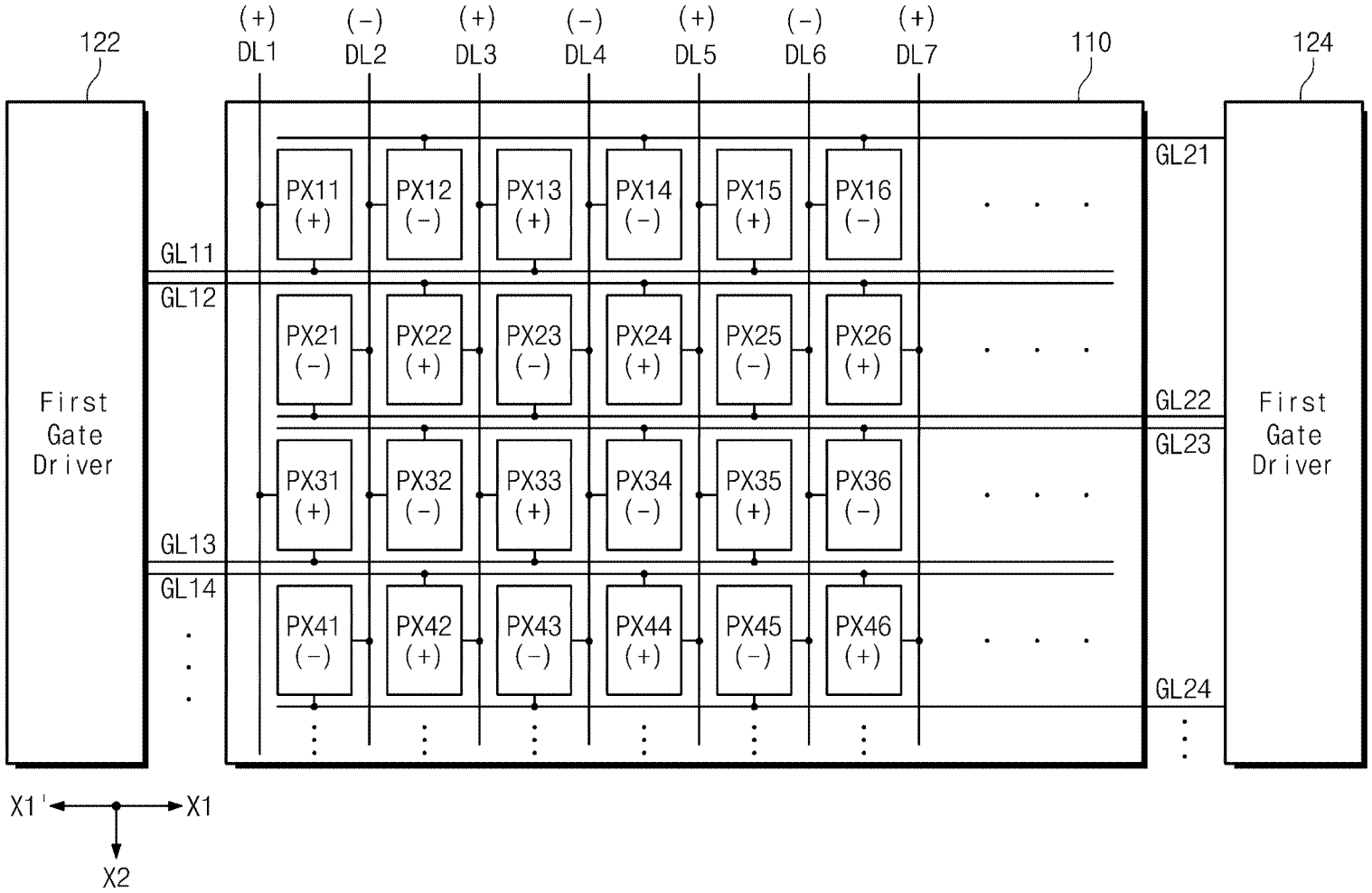
FIG. 9 is a view illustrating a portion of the display panel of FIG. 1 according to an exemplary embodiment of the present inventive concept.

FIG. 9 is a view illustrating a portion of the display panel of FIG. 1 according to an exemplary embodiment of the present inventive concept.

Referring to FIG. 9, the display panel 110 includes a plurality of pixels PX11 to PX 46. The pixels PX11, PX13, and PX15 are connected to a first gate line GL11. The pixels PX12, PX14, and PX16 are connected to a second gate line GL21. The pixels PX21, PX23, and PX25 are connected to a second gate line GL22. The pixels PX22, PX24, and PX26 are connected to a first gate line GL12. The pixels PX31, PX33, and PX35 are connected to a first gate line GL13. The pixels PX32, PX34, and PX36 are connected to a second gate line GL23. The pixels PX41, PX43, and PX45 are connected to a second gate line GL24. The pixels PX42, PX44, and PX46 are connected to a first gate line GL14. The first gate lines GL11 to GL12 adjacent to each other are arranged between the pixels PX11 and PX21, and the first gate lines GL13 to GL14 adjacent to each other are arranged between the pixels PX31 to PX41.

Each of the data lines DL1 to DL7 is disposed between every two adjacent pixels in the first direction X1. Each of the pixels PX21 and PX41 is connected to the left data line DL2 adjacent thereto.

When a positive data driving signal (+) is provided to the odd-order data lines DL1, DL3, DL5, and DL7 of the data lines DL1 to DL12 and a negative data driving signal (−) is provided to the even-order data lines DL2, DL4, and DL6 of the data lines DL1 to DL12, the pixels PX11 to PX46 of the display panel 110 may be driven in a dot inversion method.

The pixels (e.g., PX11, PX13, PX15, PX22, PX24, PX26, PX31, PX33, and PX35), each of which is connected to a corresponding one of the first gate lines (e.g., GL11, GL12, GL13, and G14) driven by the first gate driver 122, may be driven by the positive data driving signal (+), and the pixels (e.g., PX12, PX14, PX16, PX21, PX23, PX25, PX32, PX34, and PX36), each of which connected to the second gate lines GL21, GL22, GL23, and GL24 driven by the second gate driver 124, may be driven by the negative data driving signal (−). In an exemplary embodiment, the pixels (e.g., PX11, PX13, PX15, PX22, PX24, PX26, PX31, PX33, and PX35) may be driven by the negative data driving signal (−), and the pixels (e.g., PX12, PX14, PX16, PX21, PX23, PX25, PX32, PX34, and PX36) may be driven by the positive data driving signal (+).

In the display panel 110 of FIG. 9, the adjusted common voltage VCOM may be compensated by an asymmetrical driving method in which the negative frame period and the positive frame period have different lengths from each other as described with reference to FIGS. 5 to 8.

In the liquid crystal display apparatus according to an exemplary embodiment of the present inventive concept, a voltage level of the common voltage may be adjusted, and thus, the positive frame in which the pixel electrode has a voltage greater than that of the common electrode and the negative frame in which the pixel electrode has a voltage smaller than that of the common electrode may have the same light transmittance as each other. To compensate the adjusted common voltage, a period of each of the positive frame and the negative frame may be changed. Therefore, display quality of the liquid crystal display apparatus may be increased.

Although the present inventive concept has been described with exemplary embodiments thereof, it will be understood that the present inventive concept is not limited to exemplary embodiments set forth herein, and various changes in forms and details may be made therein without departing from the spirit and scope of the present inventive concept.

What is claimed is:

1. A display apparatus comprising:

a display panel comprising first pixels each connected to one of first gate lines and one of first data lines, and second pixels each connected to one of second gate lines and one of second data lines; and a driving circuit configured to drive the first and second gate lines and the first and second data lines to display an image on the display panel, wherein the driving circuit is configured to alternately provide a first polarity data driving signal and a second polarity data driving signal to each of the first and second data lines, wherein in an asymmetrical mode, the first polarity data driving signal is provided to the first data lines of the data lines during a first frame period before a blank period begins, and the second polarity data driving signal is provided to the first data lines during a second frame period after the blank period ends, wherein the second frame period during which the second polarity data driving signal is provided to the first data lines excludes the blank period, wherein the first frame period in which the first polarity data driving signal is provided to the first data lines during the asymmetrical mode is longer that a first frame period in which the first polarity data driving signal is provided to the first data lines during a normal mode.

2. The display apparatus of claim 1, wherein the driving circuit comprises:

a first gate driver configured to drive the first gate lines; and a second gate driver configured to drive the second gate lines of the gate lines.

3. The display apparatus of claim 2, wherein, when the first polarity data driving signal is provided to each of the first data lines, the second polarity data driving signal is provided to each of the second data lines.

4. The display apparatus of claim 1, wherein the second frame period in which the second polarity data driving signal is provided to the first data lines during the asymmetrical mode is shorter than a second frame period in which the second polarity data driving signal is provided to the first data lines during the normal mode.

5. The display apparatus of claim 1, wherein the first frame period in which the first polarity data driving signal is provided to the first data lines during the asymmetrical mode comprises the blank period.

6. The display apparatus of claim 1, wherein the first and second polarity data driving signals have opposite polarities to each other with respect to a common voltage.

7. The display apparatus of claim 6, wherein the driving circuit further comprises a voltage generator generating the common voltage.

8. The display apparatus of claim 7, wherein the driving circuit further comprises:

a timing controller configured to output a first control signal comprising a data signal in response to an image signal and a control signal; and a source driver configured to output the first polarity data driving signal and the second polarity data driving signal in response to the data signal and the first control signal.

9. The display apparatus of claim 8, wherein the timing controller outputs a second control signal for controlling the first gate driver and a third control signal for controlling the second gate driver in response to the control signal.

10. The display apparatus of claim 8, wherein the timing controller further outputs a fourth control signal, and wherein the voltage generator adjusts a voltage level of the common voltage in response to the fourth control signal.

11. A display apparatus comprising:

a display panel comprising first pixels each connected to one of first gate lines and one of first data lines, and second pixels each connected to one of second gate lines and one of second data lines; and a driving circuit configured to drive the first and second gate lines and the first and second data lines, wherein the driving circuit is configured to provide a first polarity data driving signal to each of the first pixels, and to provide a second polarity data driving signal to each of the second pixels in a first period, wherein the driving circuit is configured to provide the second polarity data driving signal to each of the first pixels, and to provide the first polarity data driving signal to each of the second pixels in a second period, wherein during an asymmetrical mode, a first frame in which the first polarity data driving signal is provided to each of the first pixels has a different first period, from that of a second frame in which the second polarity data driving signal is provided to each of the first pixels has a second period, and a length of the first period differs from a length of the second period.

12. The display apparatus of claim 11, wherein the first frame includes a blank period, wherein the first polarity data driving signal is provided to each of the first pixels before the blank period begins, and the second polarity data driving signal is provided to each of the first pixels after the blank period ends.

13. The display apparatus of claim 11, wherein the first and second polarity data driving signals have opposite polarities to each other with respect to a common voltage, wherein the driving circuit includes a voltage generator adjusting a voltage level of the common voltage.

14. The display apparatus of claim 13, wherein during an asymmetrical mode, an amount of difference in period between the first frame and the second frame is changed according to the adjusted voltage level of the common voltage.

15. The display apparatus of claim 11, wherein the first frame in which the first polarity data driving signal is provided to each of the first pixels during the asymmetrical mode has a longer period than that of a third frame in which the first polarity data driving signal is provided to each of the first pixels during a normal mode.

16. The display apparatus of claim 15, wherein a fourth frame in which the second polarity data driving signal is provided to each of the first pixels during the asymmetrical mode has a shorter period than a fifth frame in which the second polarity data driving signal is provided to each of the second pixels during the normal mode.

17. A display apparatus comprising:

a display panel comprising a plurality of pixels, each of which is connected to one of a plurality of gate lines and one of a plurality of data lines; and a driving circuit configured to drive the plurality of gate lines and the plurality of data lines to display an image on the display panel, wherein the driving circuit is configured to alternately provide a first polarity data driving signal and a second polarity data driving signal to each of the plurality of data lines, wherein in an asymmetrical mode, the first polarity data driving signal is provided to first data lines of the plurality of data lines during a first frame period before a blank period begins, and the second polarity data driving signal is provided to the first data lines during a second frame period after the blank period ends, wherein, when the first polarity data driving signal is provided to each of the first data lines, the second polarity data driving signal is provided to each of the second data lines, and wherein the first frame period in which the first polarity data driving signal is provided to the first data lines during the asymmetrical mode is longer than a first frame period in which the first polarity data driving signal is provided to the first data lines during a normal mode.

18. The display apparatus of claim 17, wherein the first and second polarity data driving signals have opposite polarities to each other with respect to a common voltage.

19. The display apparatus of claim 18, wherein the driving circuit further comprises a voltage generator generating the common voltage.

* * * * *